United States Patent [19]

Erichson

[11] 4,172,540

[45] Oct. 30, 1979

[54] DISPENSING CLOSURE

[75] Inventor: Herbert Erichson, Ratingen, Fed. Rep. of Germany

[73] Assignee: Polytop Corporation, Slatersville, R.I.

[21] Appl. No.: 857,381

[22] Filed: Dec. 5, 1977

[30] Foreign Application Priority Data

Dec. 24, 1976 [DE] Fed. Rep. of Germany ..... 2658805

[51] Int. Cl.[2] ..... B67D 47/08

[52] U.S. Cl. ..... 222/517; 215/235; 220/335; 220/375; 222/543

[58] Field of Search ..... 215/307, 235; 220/375, 220/332, 335; 222/543, 556, 517, 515

[56] References Cited

U.S. PATENT DOCUMENTS

| | | | |
|---|---|---|---|
| 2,894,654 | 7/1959 | Löhrer | 215/235 |
| 3,059,816 | 10/1962 | Goldstein | 222/543 X |
| 4,047,495 | 9/1977 | O'Brian | 215/224 |

*Primary Examiner*—John P. Shannon

*Attorney, Agent, or Firm*—Edward D. O'Brian

[57] ABSTRACT

A dispensing closure having a cap with an opening extending through the top of the cap and having a lid mounted on the cap so that it is capable of being moved between a closed position in which the lid closes off the opening and an open position in which the opening is exposed can be constructed so as to utilize a spring mounting the lid on the cap. One of the ends of the spring employed is secured to the cap so that the spring is incapable of being pivoted relative to the cap while the other of the ends of the spring is pivotally connected to the lid. The spring is connected to the lid at a location such that the spring has to be bent and such that the lid has to be pivoted relative to the spring in order for the lid to be moved between the noted open and closed position. The spring serves to hold the lid relative to the top of the cap so that the lid is held against movement in the open position by the spring.

10 Claims, 7 Drawing Figures

DISPENSING CLOSURE

BACKGROUND OF THE INVENTION

The invention set forth in this specification pertains to new and improved dispensing closures which are constructed so that the lids on such closures are held against movement when open.

The term "dispensing closure" is commonly utilized to designate closures which are constructed so as to include a cap or cap part adapted to be secured to or formed integrally with a container and a closure part which is mounted on the cap part so as to be capable of being manipulated between open and closed positions. In such open positions material can be moved through an opening in the cap or cap part while in such a closed position such an opening is closed off. Many such dispensing closures are constructed so that such a closure part is a spout while many other of such dispensing closures are constructed so that such a closure part is a lid.

It has been recognized that the utility of a dispensing closure in many different types of applications can be enlarged upon or improved by constructing such a closure so that the lid will be held in an open position once it has been moved into such position until such time as a deliberate force is applied to close such a closure member. It is recognized that there are a number of different ways of constructing dispensing closures so that the closure members of such closures are normally held in an open position until they are deliberately closed.

Various expedients which have been utilized in the past for temporarily holding a closure member in a dispensing closure in an open position have included a variety of different types of detent structures or detent-type structures. Various types of structures utilizing both hinge elements and toggle elements have also been utilized in securing closure members relative to the caps in dispensing closures. An understanding of the present invention is not considered to require a discussion of the relative merits of both of these types of structures.

At this time it is believed to be generally conceded that it is preferable to manufacture dispensing closures in which the closure member is a lid so as to utilize a toggle type action serving to hold the lid in an open position. The hinge and toggle type structure most commonly employed commercially for this purpose is considered to be essentially a general purpose hinge and toggle type structure such as has been known for many years. It is considered that this type of structure is disadvantageous for use as a dispensing closure for several reasons which are somewhat unique to the dispensing closure field.

Dispensing closures are most commonly mounted upon containers utilizing different types of capping machines. The type of combined hinge and toggle structure indicated in the preceding includes elements which are relatively exposed to the extent that there is danger of such elements being damaged utilizing certain conventional types of capping equipment. Further, a hinge and toggle type structure as indicated in the preceding discussion is of such a character that parts of such a structure extend outwardly from the cap of the dispensing closure when the lid is in an open position. This is considered to be disadvantageous for aesthetic type reasons.

BRIEF SUMMARY OF THE INVENTION

As a result of the factors briefly indicated in the preceding it is considered that there is a need for new and improved dispensing closures which are constructed in such a manner as to include at least one element serving to hold the closure member in such a closure in an open position against accidental or inadvertent movement toward the closed position. A broad or basic objective of the present invention is to fulfill this need.

Further objectives of the invention are to provide dispensing closures of the type indicated which may be easily and conveniently manufactured at a nominal cost and which are of such a character that they may be easily used over a prolonged period. Other objectives of the invention are to provide closures which are also of such a character that they are more advantageous than prior related closures because of their simplicity, because the manner in which they are constructed makes it possible to use them without danger of damage during handling, installation and the like, and because they are of an aesthetically acceptable character. Further objectives of this invention as well as many advantages of it will be apparent from the remainder of this specification.

In accordance with this invention these objectives are achieved by providing a dispensing closure having a cap, said cap having a top with the opening extending therethrough, a lid and mounting means connecting the lid to the cap so that the lid is capable of being moved between a closed position in which the lid closes off the opening and an open position in which the opening is exposed and in which the lid extends generally away from the top, in which the improvement comprises: the mounting means comprising a spring having ends, one of the ends being supported by the cap so that the spring is incapable of being pivoted relative to the cap, the other of the ends being pivotally connected to the lid, the spring being connected to the lid at a location such that the spring has to be bent and the lid has to be pivoted relative to the spring in order for the lid to be moved between the noted positions.

In a preferred construction in accordance with the invention the spring holds the lid so that a portion of the lid engages the top when the lid is in the open position. Also in such a preferred construction stop means are provided on the cap for limiting the amount the lid can be pivoted relative to the spring when the lid is moved from the closed to the open position. It is considered that a dispensing closure as indicated is most advantageously constructed so that the lid and the spring are integral with one another and are formed out of a resilient, flexible material enabling a mode of operation as hereinafter described.

BRIEF DESCRIPTION OF THE DRAWING

The invention is best more fully described with reference to the accompanying drawing in which.

Figure 1:
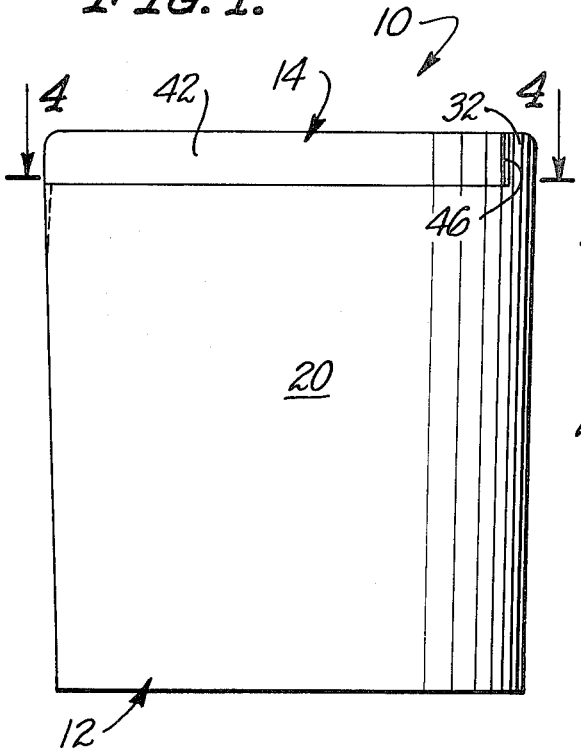
FIG. 1 is a side elevational view of a presently preferred embodiment or form of a dispensing closure in accordance with this invention with the lid of the closure in a closed position.
Figure 3:
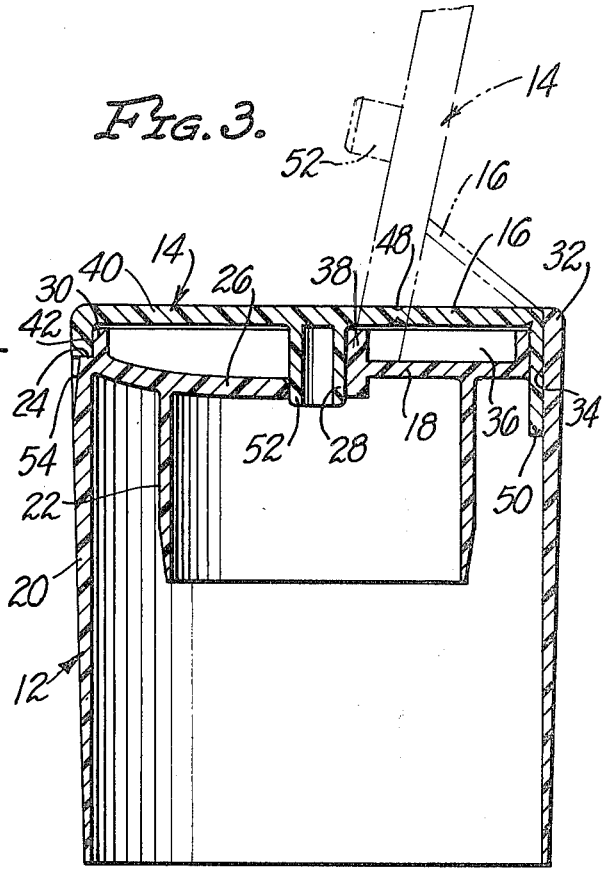
FIG. 3 is a cross-sectional view taken at line 3—3 of FIG. 2 with the position of the lid in the open position indicated by phantom lines.
Figure 2:
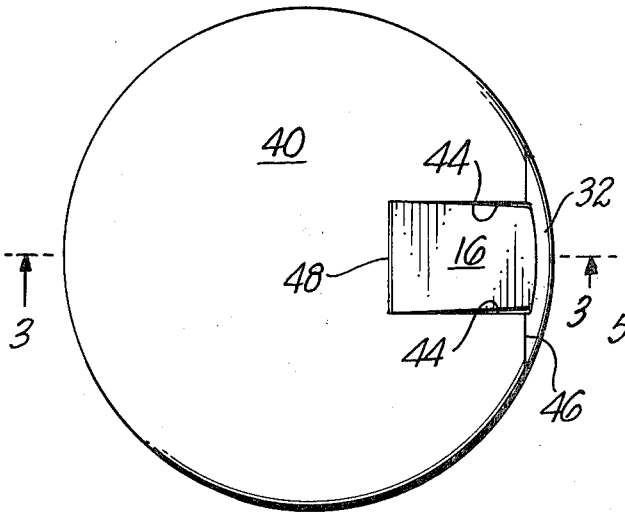
FIG. 2 is a top plan view of the closure shown in FIG. 1.
Figure 4:
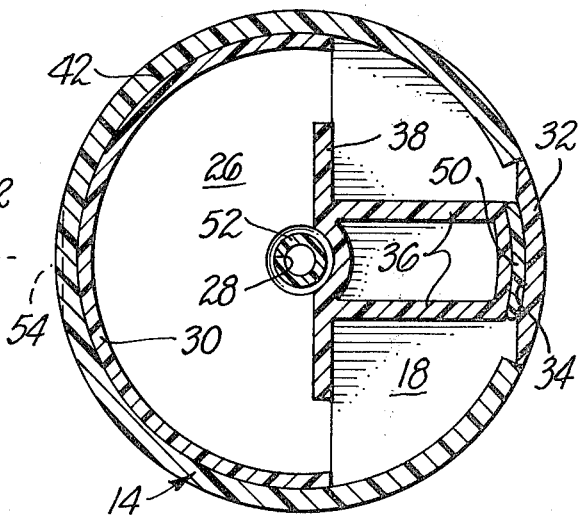
FIG. 4 is a cross-sectional view taken at line 4—4 of FIG. 1.

The particular closures illustrated in the drawings embody the operative concepts or principles set forth and defined in the appended claims. Those familiar with the design and construction of dispensing closures are cognizant of the fact that through the use or exercise of routine engineering skill it is possible to vary the construction of a dispensing closure without altering the fundamental concepts or principles involved in connection with the operation of such a closure. For this reason the invention is not to be considered as being limited to the precise closures illustrated.

DETAILED DESCRIPTION

In FIGS. 1 to 4 of the drawing there is shown a dispensing closure 10 of the present invention which is constructed so as to include a cap 12 and a lid 14. As hereinafter indicated the lid 14 is preferably constructed so as to be integral with a spring 16. The lid 14 and the spring 16 are preferably formed integrally with one another by known injection molding techniques out of any one of a wide variety of known somewhat flexible, somewhat resilient polymer materials. Various different polyolefins such as linear polyethylene or polypropylene can conveniently be used. For economic reasons it is considered preferable to form the cap 12 in the same manner out of the same or a similar material.

The cap 12 includes a top 18 attached to a conventional peripheral skirt 20 which is used in attaching the closure 10 to a conventional container neck (not shown). It is considered desirable to locate on the top 18 a dependent, cylindrical, plug-like sealing element 22 so that this element 22 is concentric with the skirt 20. This sealing element 22 is concentric with the skirt 20 and is adapted to fit within a container neck (not shown) so as to form a seal therewith. Obviously various equivalent mount and sealing structures can be employed with the closure 10.

The top 18 is of a generally flat character and includes on its upper surface 24 a downwardly sloping wall 26 leading to an opening 28. This opening 28 is centrally located within the top 18 and leads through this top 18 into the interior (not separately numbered) of the cap 12. The top 18 also includes a ridge 30 extending in a substantially circular path slightly more than 180° around the opening 28. This top also includes a small back wall 32 appearing much as an extension of the skirt 20.

This back wall 32 is located in a symmetrical manner relative to an imaginary line drawing through the center of the opening 28 and through the ridge 30 midway between the ends (not separately numbered) of this ridge 30. A short, elongated opening 34 is located so as to extend through the top 18 immediately adjacent to this back wall 32. Preferably, but not necessarily, two parallel ridges 36 extend from the extremities (not separately numbered) of the opening 34 generally toward the opening 28. These ridges 36 are connected by a straight elongated wall or ridge 38 extending across the top 18 so as to be in alignment with the extremities (not separately numbered) of the ridge 30.

The lid 14 is constructed so as to have a centrally located, generally circular body 40 located within an attached, short, annular dependent skirt 42. This body 40 is dimensioned so as to fit over the top 18 when the lid 14 is in a closed position and the skirt 42 is dimensioned so as to fit against the upper surface 24 generally on the side (not separately numbered) of the ridge 30 remote from the opening 28. When the lid 14 is closed in effect the skirt 42 appears much as a slightly enlarged rim-like continuance of the skirt 20.

The lid 14 also includes two inwardly extending slots or cut-outs 44 which extend centrally from a cut-off straight back edge 46 on the body 40. The skirt 42 does not extend along this back edge 46. These two slots 44 extend along the spring 16 when the lid 14 is in a closed position. This spring 16 is a flat, leaf-type spring which is connected to the body 40 along a line 48 of reduced cross-sectional thickness serving as a pivot so as to pivotally connect the lid 14 with the spring 16 at one of the ends (not separately numbered) of the spring 16. The other of the ends (not separately numbered) of the spring 16 is formed integrally with a mounting tab 50 which normally—i.e., when the lid 14 is in a closed position and/or before the lid 14 is assembled on the cap 12—extends at a right angle to the spring 16. This tab 50 fits closely within the opening 34 so as to secure the lid in place so that it may be moved between positions as noted and so as to close off the opening 34.

It is believed that the manner in which the closure 10 operates will be essentially self-apparent from the preceding description. The spring 16 serves to support the lid 14 at all times. In the closed position of this lid 14 the spring 16 is unstressed and serves to hold the line 48 serving as a pivot generally adjacent to the top 18. In this position of the line 48 the lid 14 fits against the top 18 so as to close off the opening 28 described in the preceding. Because of the engagement between the lid 14 and the top 18, in effect the spring 16 serves to hold or bias the lid 14 in contact with the top so that it cannot be pivoted. In order to completely seal off the opening 28 in this closed position it is preferred to locate a plug 52 on the lid 14. This plug 52 fits within the opening 28 when the lid 14 is closed to seal off the opening 28.

When the lid 14 is to be manipulated to an open position this lid 14 may be manually engaged and moved generally upwardly so as to bend the spring 16. Such manipulation of the lid 14 may, if desired, be facilitated by locating a small recess 54 in the skirt 20. As the lid 14 is moved upwardly and as the spring 16 is bent the line 48 will of course be elevated relative to the top 18. As this occurs the lid 14 may be pivoted to an open position relative to the spring 16 and the top 18. Preferably the wall 38 is used with the noted structure so as to tend to limit the amount of such rotation. Thus, this wall 38 acts as a stop means engaging the lid 14 limiting the amount that the lid 14 may be rotated about the line 48 as the spring 16 is deformed.

When the lid 14 is in contact with the wall 38 it may be released and it will automatically stay in an open position in which the spring 16 biases the lid 14 against the top 18 and the wall 38. This will serve to hold the lid 14 open until such time as the lid 14 is manipulated in the reverse of the manner previously described to a closed position. In order for this action to be achieved the lid 14 must be pivoted relative to the line 48 a sufficient extent so that it is to be left of the line 48 as viewed in FIG. 3 when it is open.

Figure 5:
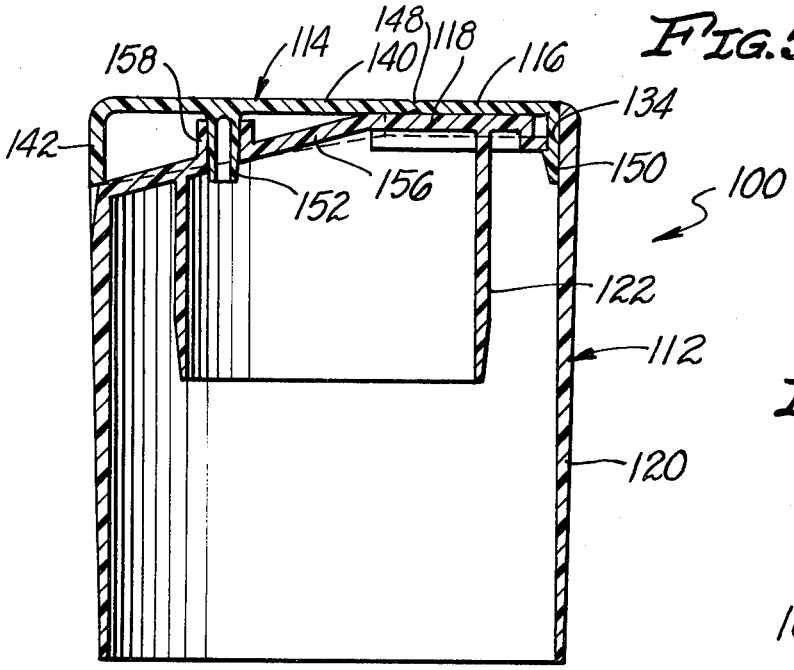
FIG. 5 is a cross-sectional view of a modified dispensing closure in accordance with the invention corresponding to FIG. 3 with the lid shown in a closed position.
Figure 6:
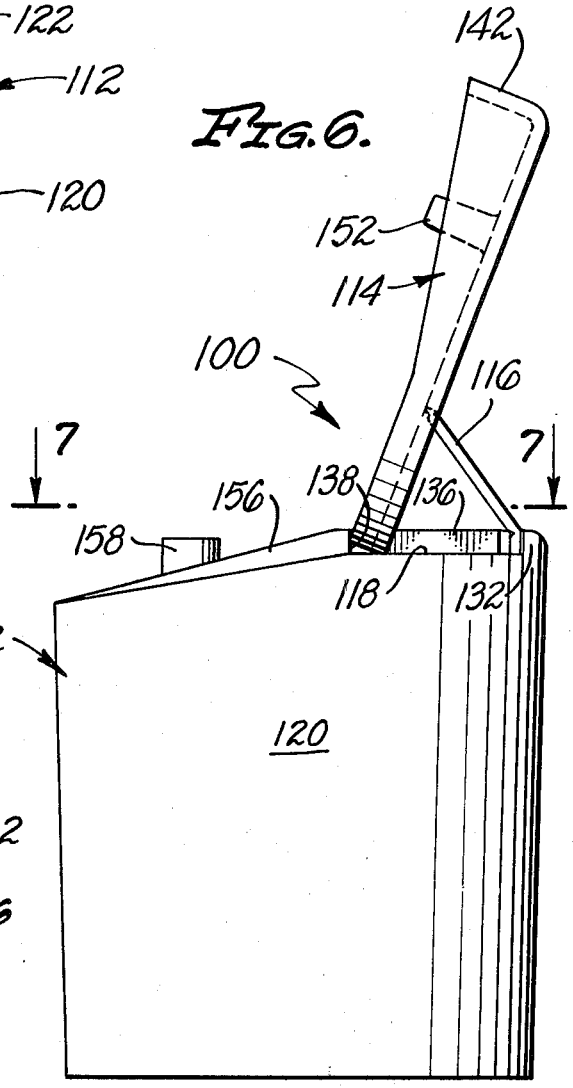
FIG. 6 is a side elevational view of the closure shown in FIG. 5 with the lid in an open position.
Figure 7:
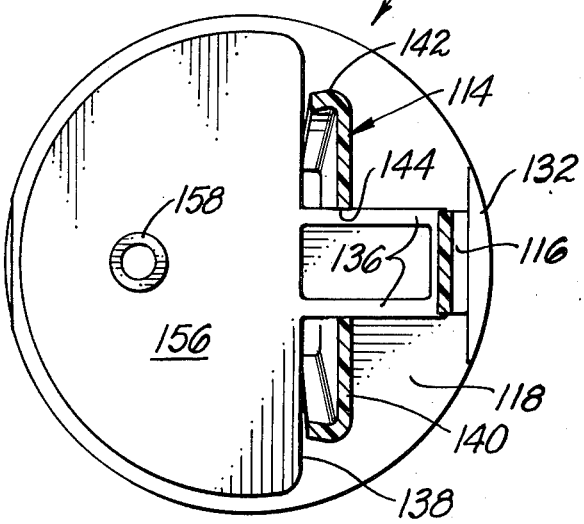
FIG. 7 is a cross-sectional view taken at line 7—7 of FIG. 6 showing practically all of the top of the cap of the closure in elevation.

In FIGS. 5, 6 and 7 of the drawing there is shown a modified closure 100 which is quite similar to the closure 10 previously described. In the interest of brevity those parts of the closure 100 which reasonably correspond to parts of the closure 10 are not separately described herein and are indicated in the remainder of this specification and in the drawing by the numerals previously utilized to describe such parts preceding by the numeral "1.".

The closure 100 differs from the closure 10 primarily in that it is designed so as to obtain a spout type delivery of materials passing through the closure 100. The essential difference between the closures 100 and 10 lies in the fact that the closure 100 substitutes for the sloping wall 26 a generally upstanding wall 156 of a somewhat curved configuration. Upon this wall 156 there is located a tubular nozzle-like protuberance 158 which is utilized instead of the opening 28. It is considered obvious that with this structure 100 liquid will not tend to drain back into an opening corresponding to the opening 28 in the closure 10.

I claim:

1. A dispensing closure having a cap, said cap having a top with an opening extending therethrough, a lid and mounting means connecting said lid with said cap so that said lid is capable of being moved between a closed position in which said lid closes off said opening and an open position in which said opening is exposed and in which said lid extends generally away from said top in which the improvement comprises:

said mounting means comprising only a spring means having ends, one of said ends being supported by said cap so as to hold said spring means so that said spring means is capable of being temporarily deformed relative to said cap, the other of said ends being pivotally connected to said lid, said spring means being connected to said lid at a location such that said spring means has to be bent and said lid has to be pivoted relative to said spring means in moving said lid between said open and closed positions, said spring means biasing said lid against said cap in order to hold said lid in said open position.

2. A dispensing closure as claimed in claim 1 wherein:

said spring means holds said lid so that a portion of said lid engages said top when said lid is in said open position.

3. A dispensing closure as claimed in claim 1 including:

stop means are provided on said cap for limiting the amount said lid can be pivoted relative to said spring means when said lid is moved from said closed to said open position.

4. A dispensing closure as claimed in claim 1 wherein:

said spring means holds said lid so that a portion of said lid engages said top when said lid is in said open position, stop means are provided on said cap for limiting the amount said lid can be pivoted relative to said spring means when said lid is moved from said closed to said open position.

5. A dispensing closure as claimed in claim 1 wherein:

said lid and said spring means are integral with one another and are formed out of a flexible, resilient material capable of being deformed at the juncture of said other of said ends of said spring means and said lid so as to pivotally connect said lid to said spring means.

6. A dispensing closure as claimed in claim 5 wherein:

said spring means includes an integral tab extending from said one of said ends of said spring means, said cap includes a recess formed therein, said tab fitting within and engaging the interior of said recess so as to mount said spring means and said lid on said cap.

7. A dispensing closure as claimed in claim 1 wherein:

said spring means is an elongated flap spring having a width, said one of said end of said spring means is pivotally connected to said lid along said width, said other of said ends of said spring means is secured to said cap along said width.

8. A dispensing closure having a cap, said cap having a top with an opening extending therethrough, a lid and mounting means connecting said lid with said cap so that said lid is capable of being moved between a closed position in which said lid closes off said opening and an open position in which said opening is exposed and in which said lid extends generally away from said top in which the improvement comprises:

said mounting means comprising only a spring having ends, one of said ends being supported by said cap so as to hold said spring so that said spring is capable of being temporarily deformed relative to said cap, the other of said ends being pivotally connected to said lid, said spring being connected to said lid at a location such that said spring has to be bent and said lid has to be pivoted relative to said spring, said lid and said spring being integral with one another and formed out of a flexible, resilient material capable of being deformed at the juncture of said other of said ends of said spring and said lid so as to pivotally connect said lid to said spring, said spring including an integral tab extending from said one of said ends of said spring, said cap including a recess formed therein, said tab fitting within and engaging the interior of said recess so as to mount said spring and said lid on said cap.

9. A dispensing closure having a cap, said cap having a top with an opening extending therethrough, a lid and mounting means connecting said lid with said cap so that said lid is capable of being moved between a closed position in which said lid closes off said opening and an open position in which said opening is exposed and in which said lid extends generally away from said top in which the improvement comprises:

said mounting means comprising a spring having ends, one of said ends being supported by said cap so as to hold said spring so that said spring is capable of being temporarily deformed relative to said cap, the other of said ends being pivotally connected to said lid, said spring being connected to said lid at a location such that said spring has to be bent and said lid has to be pivoted relative to said spring, said spring being an elongated flap spring having a width, said one of said ends of said spring being pivotally connected to said lid along said width, said other of said ends of said spring being secured to said cap along said width, the other of said ends of said spring including a tab attached thereto, said tab extending across said width of said spring, holding means on said cap engaging said tab so as to support said lid and said spring on said cap.

10. A dispensing closure as claimed in claim 9 wherein:

said lid and said spring means and said tab are integral with one another and are formed of a material which has resilient, flexible characteristics.

* * * * *